US006780287B2

(12) United States Patent
Sakuma et al.

(10) Patent No.: US 6,780,287 B2
(45) Date of Patent: Aug. 24, 2004

(54) BELT FOR CALENDERING

(75) Inventors: Norio Sakuma, Tokyo (JP); Yasuhiro Tsutsumi, Tokyo (JP); Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 153 days.

(21) Appl. No.: 10/131,319

(22) Filed: Apr. 24, 2002

(65) Prior Publication Data

US 2003/0201086 A1 Oct. 30, 2003

(30) Foreign Application Priority Data

Jun. 28, 2001 (JP) ..... 2001-195847

(51) Int. Cl.[7] ..... D21G 1/00

(52) U.S. Cl. ..... 162/358.4; 162/361; 162/901; 100/173; 428/217

(58) Field of Search ..... 162/358.2, 358.3, 162/358.4, 900–904, 348, 306; 100/153, 155 R, 156, 173, 110, 118, 121, 122; 428/192, 193, 174, 175, 177, 213, 217

(56) References Cited

U.S. PATENT DOCUMENTS 290,147 A * 12/1883 Tullis ..... 474/269
4,238,287 A * 12/1980 Gill ..... 162/358.4
4,877,472 A * 10/1989 Rodal ..... 156/184
5,422,165 A * 6/1995 Arnold ..... 428/192
5,766,421 A * 6/1998 Aufrecht ..... 162/358.4
5,836,242 A * 11/1998 Aberg ..... 100/327
5,943,951 A * 8/1999 Muellner et al. ..... 100/37
6,042,695 A * 3/2000 Ishino ..... 162/358.4
6,116,156 A * 9/2000 Schiel et al. ..... 100/118
6,584,688 B2 * 7/2003 Matuschczyk ..... 29/895.32

FOREIGN PATENT DOCUMENTS

DE 44 01 580 A1 * 6/1994 ..... D21F/3/02
JP 60-88193 5/1985
JP 10-501852 2/1998

* cited by examiner

*Primary Examiner*—Steven P. Griffin
*Assistant Examiner*—Eric Hug
(74) *Attorney, Agent, or Firm*—Howson and Howson

(57) ABSTRACT

A relatively low-cost calendering belt having excellent heat resistance and durability comprises a central portion 30, and left and right side portions 20 located at the sides of the central portion. The right and left portions 20 comprise high molecular weight elastic material having greater heat resistance than that of the central portion 30. The central portion 30 is composed of high-molecular elastic material, the durability of which is higher than that of the right and left portions 20. The heat of the calender roll CR is intercepted by a paper W, and consequently is not transmitted to the central portion 30 of the calender belt. The right and left portions 20 of the calender belt, which are not protected by paper W do not deteriorate readily as a result of the heat of the calender roll CR because of their heat resisting property.

11 Claims, 6 Drawing Sheets

FIG.7

| EXAMPLE | WIDTH OF RIGHT AND LEFT PORTIONS (mm) | MATERIAL OF RIGHT AND LEFT PORTIONS | MATERIAL OF MAIN PORTION | ENDURANCE TEST I (PULLED BY TENSILE ROLLER) | | ENDURANCE TEST II (PRESSURIZED BY TOP ROLLER) | | |
|---|---|---|---|---|---|---|---|---|
| | | | | TEMPERATURE OF ROLLER 150℃ | TEMPERATURE OF ROLLER 300℃ | 10kgf/cm² | 50kgf/cm² | 100kgf/cm² |
| 1 | 150 | PTFE | POLYURETHANE (HARDNESS 98°) | SMOOTH ON THE WHOLE SURFACE | SMOOTH ON THE WHOLE SURFACE | NO CRACKS | NO CRACKS | NO CRACKS |
| 2 | 100 | PTFE | POLYURETHANE (HARDNESS 98°) | SMOOTH ON THE WHOLE SURFACE | SMOOTH ON THE WHOLE SURFACE | NO CRACKS | NO CRACKS | NO CRACKS |
| 3 | 100 | SILICONE RUBBER | POLYURETHANE (HARDNESS 98°) | SMOOTH ON THE WHOLE SURFACE | SMOOTH ON THE WHOLE SURFACE | NO CRACKS | NO CRACKS | NO CRACKS |
| 4 | 80 | FLUORO RUBBER | POLYURETHANE (HARDNESS 98°) | SMOOTH ON THE WHOLE SURFACE | A FEW CRACKS AT RESIN BONDING SURFACE | NO CRACKS | NO CRACKS | 89 HOURS |
| 5 | 50 | FLUORO RUBBER | POLYURETHANE (HARDNESS 98°) | A FEW CRACKS AT RESIN BONDING SURFACE | CRACKS AT RESIN BONDING SURFACE AND SEPARATION OF RESIN AT BONDING SECTION | 50 HOURS | 25 HOURS | 15 HOURS |
| COMPARATIVE EXAMPLE | 0 | NONE | POLYURETHANE (HARDNESS 98°) | CRACKS AND SEPARATION OF RESIN ON THE WHOLE SURFACE OF RESIN | CRACKS AND SEPARATION OF RESIN ON THE WHOLE SURFACE OF RESIN | 10 HOURS | 5 HOURS OR LESS | 5 HOURS OR LESS |

BELT FOR CALENDERING

FIELD OF THE INVENTION

This invention relates to improvements in calendering belts for use in a calendering apparatus for papermaking.

BACKGROUND OF THE INVENTION

In the manufacture of paper, calendering is carried out by a calendering apparatus, which is a rolling machine used in a latter stage in the papermaking process, after raw material is processed in a papermaking machine to produce a web, and the web is compressed and dried. The purpose of the calendering process is to make the surface of paper smooth, to impart a gloss to the paper, and to make the thickness and density of the paper uniform. Calendering is indispensable for improving the quality of paper. When the surface of paper is rugged rather than smooth, or its thickness varies from one location to another, the appearance of the paper is unsatisfactory, and uneven printing can occur on the surface of the paper in the printing process. Moreover, if the density of paper is not uniform, even if the surface is smooth, printing performance will be impaired, because the rate of ink absorption will vary from one location to another.

A calendering apparatus makes the surface of paper smooth by the application of pressure to the paper by a pressurizing means having a smooth surface. Known calendering apparatuses include a "machine calender" that uses a pair of rollers made of steel, and a "super calender" having multi-stage pressurizing means composed by rollers made of steel and rollers having elastic covers.

In the case of the machine calender, the pressure cannot be relieved in the pressurizing part of the machine composed of the rollers, because both rollers are made of steel. Moreover, because the rollers come into contact with each other along a line, a large pressure will inevitably be applied along that line to the paper. A problem encountered with the machine calender is that, if a rugged paper is processed with such an apparatus, a relatively low pressure will be applied to the concave portions while a relatively high pressure will be applied to the convex portions. After the rugged paper passes through the machine calender, the areas corresponding to the concave portions will have a lower density than the areas corresponding to the convex portions. As a result, the density of the entire paper cannot be made uniform.

On the other hand, in case of a super calender, even in if the paper has a rugged surface, large pressure will not be applied locally because the use of the elastic cover results in an enlargement of the contact area of the two rollers. They contact each other over a relatively wide area rather than on a narrow line. As a result, in the case of a super calender, pressure is applied to the paper uniformly, and excessive pressure may be relieved due to the deformation of the elastic covers.

However, in case of the super calender, heat is likely to accumulate between the elastic cover and the roller while in use, and consequently the elastic cover is likely to deteriorate, and may eventually separate from the roller.

The above-mentioned problem, has been addressed by a calender apparatus utilizing an endless calendering belt having elasticity, as shown in FIGS. 5(*a*) and 5(*b*).

FIG. 5(*a*) shows an apparatus in which the pressurizing part is composed of a calender roller CR and a pressing roller PR, and FIG. 5(*b*) is an apparatus in which the pressurizing part is composed of a calender roller CR and a shoe S. In both cases, an endless calendering belt 100 and the paper W, which is subjected to the calendering process, are sandwiched in the pressurizing part.

The surface of the calender roller CR which comes into contact with the paper W is smooth and is heated to about 100° C. to 200° C. by a heating apparatus (not shown).

When a paper W, having a rugged surface resulting from the papermaking process, passes the pressurizing part of the calendering apparatus of FIG. 5(*a*) or FIG. 5(*b*), the surface of the paper W that contacts the calender roller CR is pressed by the calender roller and made smooth by heat and pressure. However, the opposite side, i.e., the back, of the paper W is not made smooth, because the calendering belt 100, with which it comes into contact, deforms elastically, following the ruggedness of the paper W.

Therefore, these calendering apparatuses can make one surface of the rugged paper W adequately smooth, and the density of the paper W will not exhibit marked local variations.

The calendering apparatuses of FIGS. 5(*a*) and 5(*b*) also have the advantage of excellent durability, because the calendering belt 100 is relatively long, and the heat generated in the pressurizing part is radiated efficiently.

In the calendering belt 100 used in a calendering apparatus shown in FIGS. 5(*a*) and 5(*b*), it is necessary that the web side surface WP, which comes into contact with the paper web W, be flexible, and that the pressing side surface MP, which comes into contact with the pressing roller PR or the shoe S, have good durability and wear resistance.

Based on the foregoing considerations, calendering belts have been designed in which the layer on the web side is made of a comparatively flexible high molecular weight material, and the layer on the pressing side is made of a high molecular weight elastic material which is comparatively hard. Such a belt is disclosed in Unexamined PCT Publication No. 501852/1998. Another calendering belt, in which the high molecular weight elastic material of the web side layer contains bubbles so as to increase its flexibility, is disclosed in Unexamined Japanese Patent Publication No. 88193/1985.

The calendering belt 100, which consists chiefly of high-molecular elastic material, lacks adequate heat resistance, and the portion which comes in contact with the calender roller CR readily deteriorates as a result of exposure to heat. The heat of the calender roller CR is intercepted by the paper W, and is not transmitted to the calendering belt 100 which is on the back side of the paper W. However, because the width of the calendering belt 100 is usually greater than the width of the paper W, both margins of the calendering belt 100 will come into direct contact with the calender roller CR at a high temperature in the pressurizing part of the apparatus. As a result, at both margins of the calendering belt 100, cracks may be generated, and wear becomes more severe due to deterioration and distortion caused by heat.

It is possible to use heat-resistant resins to improve the heat resisting property of the calendering belt 100. But in that case, premature wear of the pressing side WP becomes a problem, because heat resistant resins are generally inferior in durability.

Although fluorocarbon resins such as PTFE (polytetrafluoroethylene) are known as high molecular weight elastic materials having excellent heat resistance and durability, they are expensive, and therefore it is not realistic to manufacture a relatively long calendering belt 100 from such materials.

Because of the foregoing considerations, heretofore, it has not been possible to achieve durability, wear resistance and heat resistance simultaneously at a relatively low-cost in conventional calendering belt.

The improved calendering belt in accordance with the invention is an endless belt comprising a main central portion, and right and left portions located along the right and left sides of the main central portion, said right and left portions comprising high molecular weight elastic material with heat resistance greater than the heat resistance of the main central portion, and said main central portion comprising high molecular weight elastic material having durability higher than the durability of the right and left portions. The improved endless calendering belt also preferably has reinforced edge portions located along the outer edges of the right and left portions, the reinforced edge portions comprising high molecular weight elastic material having durability higher than the durability of said right and left portions.

The right and left portions do not readily deteriorate as a result of heat, even if they come into direct contact with the hot calender roller, because the heat resistance of the right and left portions is higher than that of the main portion. The main portion is not worn out easily even if it is repeatedly compressed in the pressing part of the calendering apparatus, because the durability of the main portion is higher than that of the right and left portions.

BRIEF DESCRIPTION OF THE DRAWINGS

FIG. 2(*b*) is a sectional view, corresponding to FIG. 2(*a*), but in which the paper web is laterally displaced;

FIG. 4(*b*) is a sectional view of the main portion of a calendering belt in accordance with the invention, in which high-molecular elastic material is provided throughout the entire base portion, on the paper contacting side only;

FIG. 4(*c*) is a sectional view of the main portion of a calendering belt in accordance with the invention, in which high-molecular elastic material is provided in a part of the base portion, on the paper contacting side only;

FIG. 5(*b*) is a schematic elevational view of a calendering apparatus in which a calendering belt in accordance with the invention is used, and in which the pressurizing part is composed of a calender roller and a shoe;

FIG. 7 is a table showing the results of tests carried out using the test apparatus of FIG. 6.

DETAILED DESCRIPTION OF THE PREFERRED EMBODIMENTS

Figure 1:
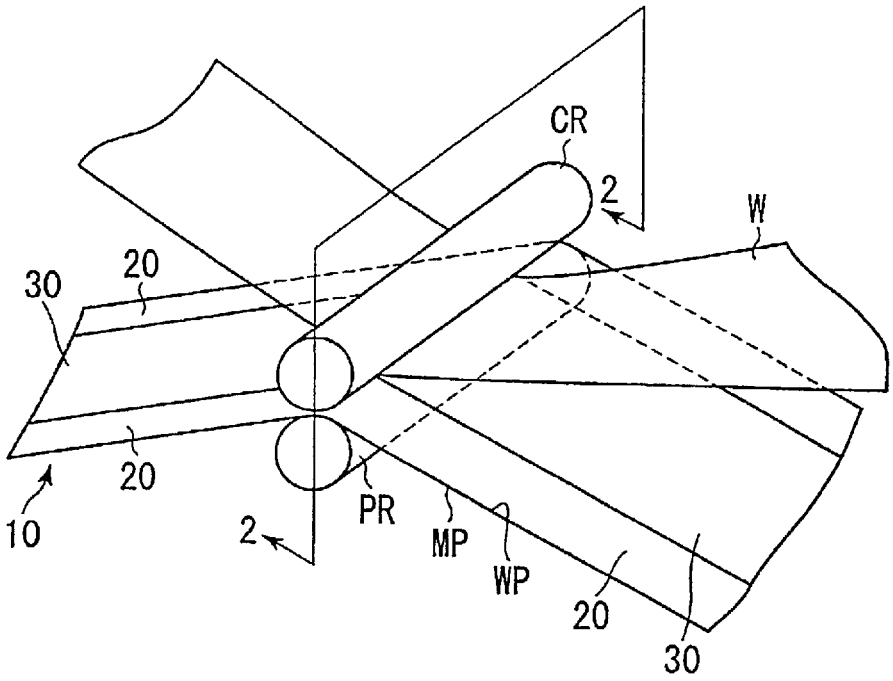
FIG. 1 is a perspective view of a calendering apparatus in which a calendering belt of the invention is used.
Figure 5A:
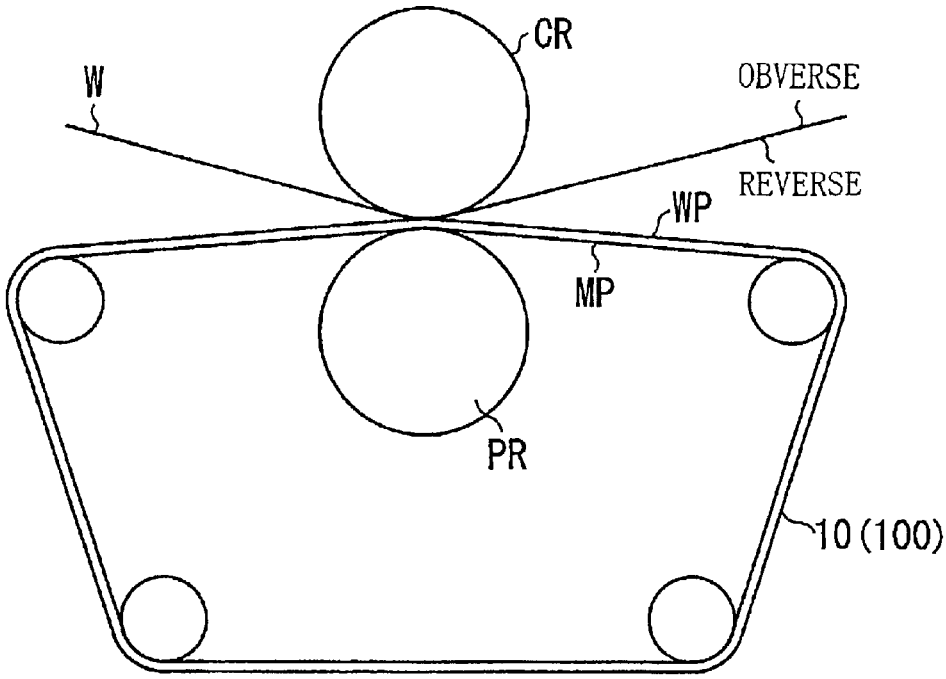
FIG. 5(*a*) is a schematic elevational view of a calendering apparatus in which a calendering belt in accordance with the invention is used, and in which the pressurizing part is composed of a calender roller and a pressing roller.
Figure 5B:
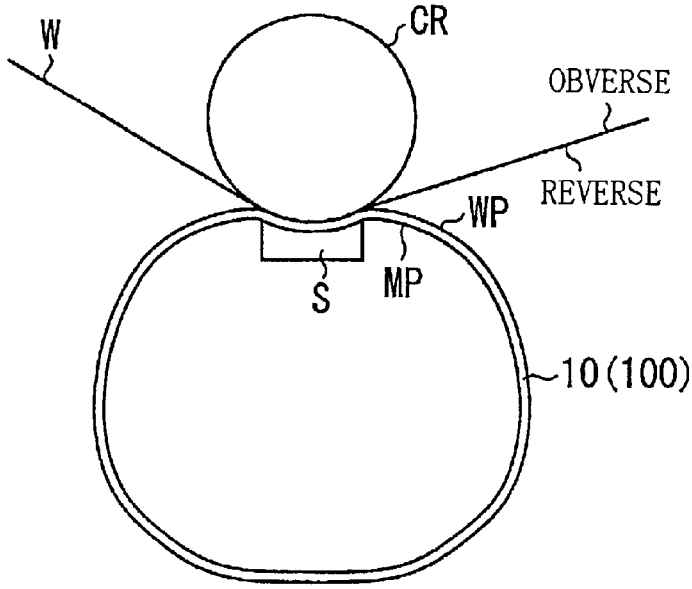

The calendering belt in accordance with the invention will be explained with reference to the calendering apparatus of FIG. 5(*a*), in which a calendering belt 10 in accordance with the invention is used. FIG. 1 shows the same apparatus in perspective view.

As in the case of a conventional calendering belt, the calendering belt 10 according to the invention comprises high molecular weight elastic material as a whole, and has a web side WP which comes into contact with the paper W as well as a pressing side MP which comes into contact with the pressing roller PR. In use, the belt 10 passes between the calender roller CR and the pressing roller PR of the calendering apparatus, and the paper W is on the web side WP.

The calendering belt 10 comprises three sections: a main portion 30 located centrally between the side edges, and right and left marginal portions 20, located on the respective sides of the main portion 30. The right and left portions 20 and 20 are composed of a high molecular weight elastic material with high heat resistance, and the main portion 30 is made of high molecular weight elastic material having high durability.

High molecular weight elastic materials having suitable heat resistance, for composing the right and left marginal portions 20 of the belt, include PTFE (polytetrafluoroethylene) which is a fluoro resin, FEP (copolymer of tetrafluoroethylene/hexafluoroethylene), ETFE (copolymer of ethylene/tetrafluoroethylene), AMC (acrylic rubber) which is a heat-resisting rubber material, EAR (ethylene acrylic rubber), EPDM (ethylene propylene-diene rubber), fluoro rubber, silicone rubber, CM (chlorinated polyethylene rubber), CSM (chlorosulfonated polyethylene rubber), IIR (isobutylene-isoprene rubber) and so forth.

Various high molecular weight rubbers and elastomers have superior durability for composing the main portion 30 of the belt. Polyurethane (hardness 80–95°), for example, is suitable.

Figure 2:
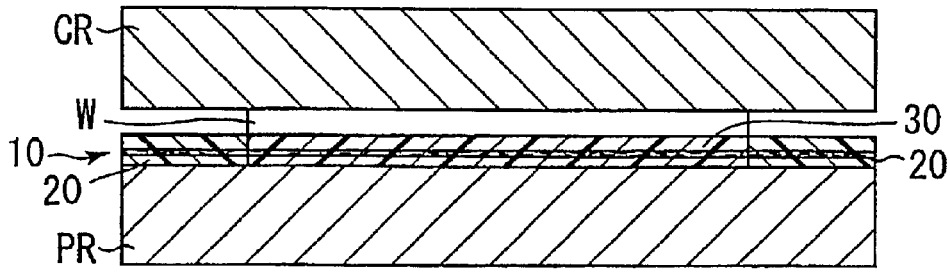
FIG. 2(*a*) is a sectional view taken on plane 2—2 of FIG. 1, showing a paper web in place on the main portion of the belt.
Figure 2:
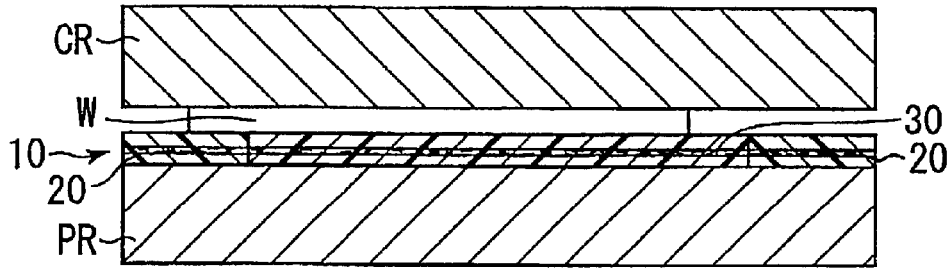

The paper W, which undergoes the calendering process as shown in FIG. 2(*a*) is usually in register with the main portion 30 of the calendering belt 10 at the location of the pressing part of the calendering apparatus, and the width of the main portion 30 is almost equal to the width of the paper web W.

In the pressurizing part, heat from the calender roller CR is intercepted by the paper W, and is not transmitted readily to the calendering belt 10 when the paper and calendering belt are compressed between the calender roller CR and the pressing roller PR. Therefore, high temperatures, at which the main portion 30 of the belt 10 deteriorates, are not transmitted to the main portion 30 of the belt.

On the other hand, when pressurized by both rollers CR and PR, the right and left marginal portions 20 of the belt, which are not protected by the paper W, come into direct contact with the calender roller CR, which is at a high temperature. However, since the right and left marginal portions are made of high molecular weight elastic material with high heat resistance, the effect of heat on the right and left portions 20 is minimal and not readily apparent.

As shown in FIG. 2(*b*), even if the paper web W which undergoes the calendering process is laterally offset somewhat from the main portion 30 so that the paper web W and the main portion of the belt are out of register with each other, there should be no problem, provided that the majority of the main portion 30 is protected by the paper W. In other words, provided the paper web W is arranged so that its edges are in the vicinity of the boundaries of the right and left portions 20 and the main portion 30, the main portion 30 is unlikely to be affected by the heat of the calender roller CR.

Expensive, heat-resistant, high molecular weight elastic material is needed only for the right and left portions 20. Consequently, the manufacturing cost of the belt can be reduced by adoption of the above-described composition and structure. Moreover, the belt does not readily wear out, even though it comes into contact with the pressing roller, because the main portion of the belt comprises a high molecular weight elastic material having high durability.

Usually, the sideward edges of the right and left portions of a calendering belt are places where the pressure applied on the belt is release, and when the belt is installed in a calendering apparatus, these edges are likely to knock against various machine parts. Consequently, it is desirable that those edges be stronger than other sections.

Figure 3:
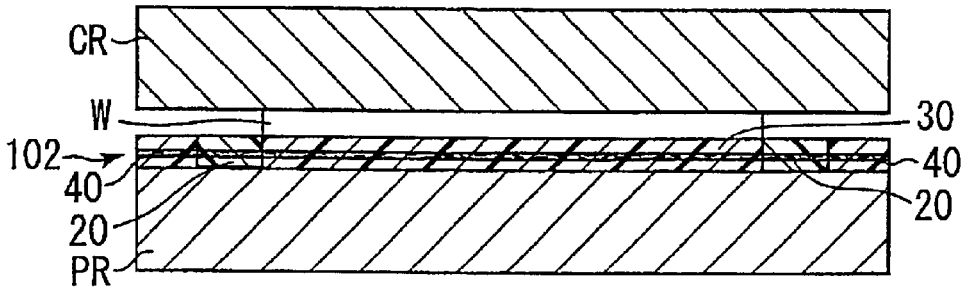
FIG. 3 is a sectional view taken on plane 2—2 of FIG. 1, showing the use of a calendering belt in accordance with the invention, provided with reinforced edge portions.

As shown in FIG. 3, durability may be improved by providing reinforced edge portions 40, which comprise high molecular weight elastic material with high strength, at the right and left edges of the calendering belt 102.

At the boundaries of the right and left portions 20 and the main portion 30 of the calendering belt 10, the materials may mix with each other, although the boundaries in question are shown by straight lines in FIGS. 2(*a*) and 2(*b*).

The compositions and the manufacturing methods of the calendering belt 10 of the invention shown in FIGS. 2(*a*) and 2(*b*) will now be explained.

Figure 4A:
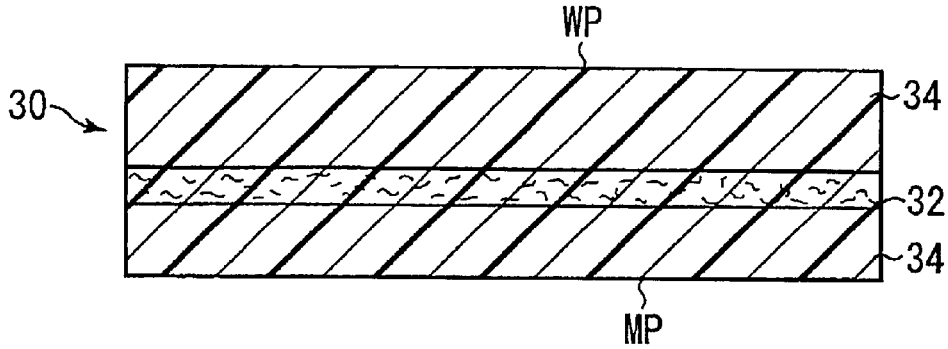
FIG. 4(*a*) is a sectional view of the main portion of the calendering belt, formed with layers comprising high-molecular elastic material on the obverse and reverse sides of a base portion.
Figure 4B:
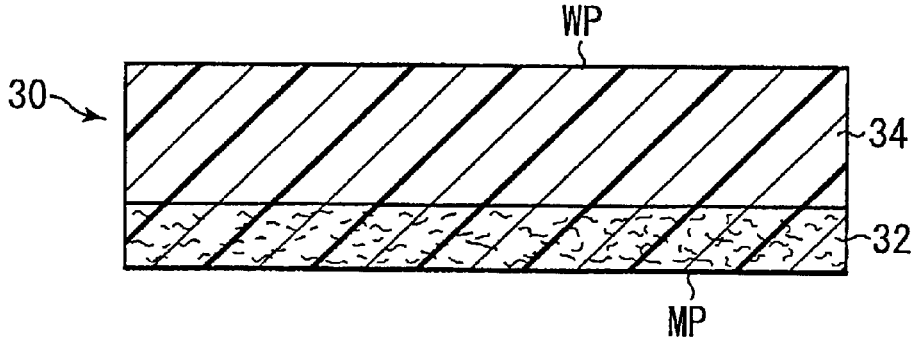
Figure 4C:
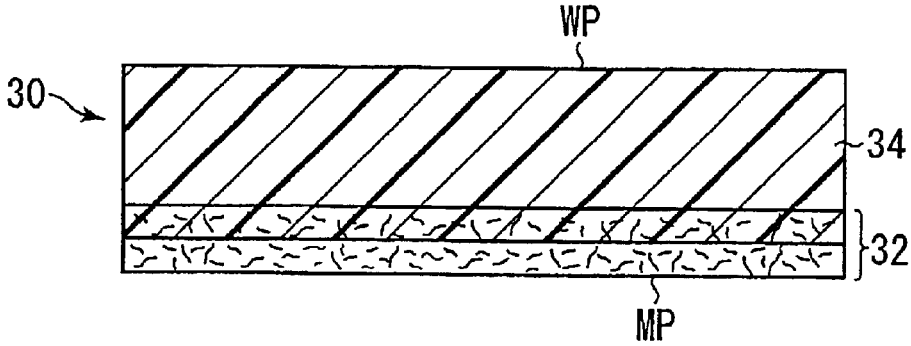

FIGS. 4(*a*), 4(*b*) and 4(*c*) are sectional views of the main portion 30 of various calendering belts 10 in accordance with the invention. The main portion 30 comprises a base portion 32 and a resin part 34. The base portion 32 comprises a woven fabric composed of warp and weft yarns, a cloth in which a warp and weft are made to overlap each other, or a cloth in which an elongate cloth element is wound in a spiral. The purpose of the base portion is to impart the strength that is needed for a calendering belt.

In the case depicted in FIG. 4(*a*) two resin parts 34, which comprise a high molecular weight elastic material, lie respectively on the obverse and reverse sides of a base portion 32. The high molecular weight elastic material is caused to impregnate the base portion 32. Alternatively, in the case depicted in FIG. 4(*b*), high molecular weight elastic material is caused to impregnate the base portion 32 and the high molecular weight elastic material is caused to accumulate, as a resin part 34, on only one side of the belt, which is the side that comes into contact with the paper web. In a third case, as depicted in FIG. 4(*c*), the high molecular weight elastic material is caused to impregnate a part of the base portion 32, and the high molecular weight elastic material is caused to accumulate only on the one side of the belt that comes into contact with the paper. With the resin part 34 formed as in FIG. 4(*c*), the machine-contacting side is composed of the base portion 32 only.

There are two methods of manufacturing a belt in which the layer of high molecular weight elastic material is arranged on the obverse and reverse sides of the base portion 32 as shown in FIG. 4(*a*).

One method is to impregnate the base portion 32 with the high molecular weight elastic material, and then cause the elastic material to accumulate further on the base portion and cure to form a first layer of high molecular weight elastic material on one side of the base portion, then reversing the assembly, impregnating the base portion 32 with high molecular weight elastic material on its other side, and then accumulating and curing further elastic material to form a second layer of the high molecular weight elastic material on said other side of the base portion.

In an alternative method, the assembly is not reversed. Rather, the high molecular weight elastic material is made to impregnate and pass through the base portion 32 to form one layer on the bottom side, and then further high molecular weight elastic material is accumulated onto the base portion 32 to form the other layer.

To form the main portion 30 of the belt, high molecular weight elastic material is caused to impregnate the central part of the base portion 32, which corresponds to the main portion 30, and is then spread and caused to accumulate further on the central part of the base portion. Before the high molecular weight elastic material cures, a high molecular weight elastic material having a heat resisting property is caused to impregnate the parts of the base portion 32 corresponding to the right and left portions 20 of the belt. The heat-resistant, high molecular weight elastic material is spread and accumulated on the right and left portions 20. Afterwards the entire assembly is heated, and the high molecular weight elastic materials are cured, so that the right and left portions 20 are integrated with the main portion 30.

At the boundaries where the right and left portions 20 meet the main portion 30, the high molecular weight elastic materials mix, and an IPN (inter penetration network) is formed, strongly bonding both materials.

Especially if the heat-resistant, high molecular weight elastic material is spread onto the right and left edges while the high molecular weight elastic material of the main portion 30 is still liquid, the union at the boundaries where the right and left portions 20 meet the main portion 30 becomes stronger. Of course, the methods of manufacturing the right and left portions 20 and the main portion 30 are not limited to the above-mentioned examples, and a variety of other manufacturing methods can be adopted.

Examples of the calendering belt 10 of the invention will now be explained.

In Example 1, polyurethane was used in the main portion and PTFE was used for the right and left portions. The width of each of the right and left portions was 150 mm, and the width of the main portion was 200 mm, so that the total width of the calendering belt was 500 mm.

The calendering belt of Example 2 had the same composition as the belt of Example 1, but the width of each of the right and left portions was 100 mm, and the width of the main portion was 300 mm.

In Example 3, polyurethane was used in the main portion and silicone rubber was used for the right and left portions. The width of each of the right and left portions was 100 mm and the width of the main portion was 300 mm. so that the calendering belt had a total width of 500 mm.

The belt of Example 4 had the same composition as that of Example 3, but the width of each of the right and left portions was 80 mm and the width of the main portion was 340 mm.

In the belt of Example 5, polyurethane was used in the main portion and fluoro rubber was used for the right and left portions. The width of each of the right and left portions was 50 mm, and the width of the main portion was 400 mm, for a total belt width of 500 mm.

A calendering belt 500 mm in width, which consisted of polyurethane, was made as a comparative example.

Figure 6:
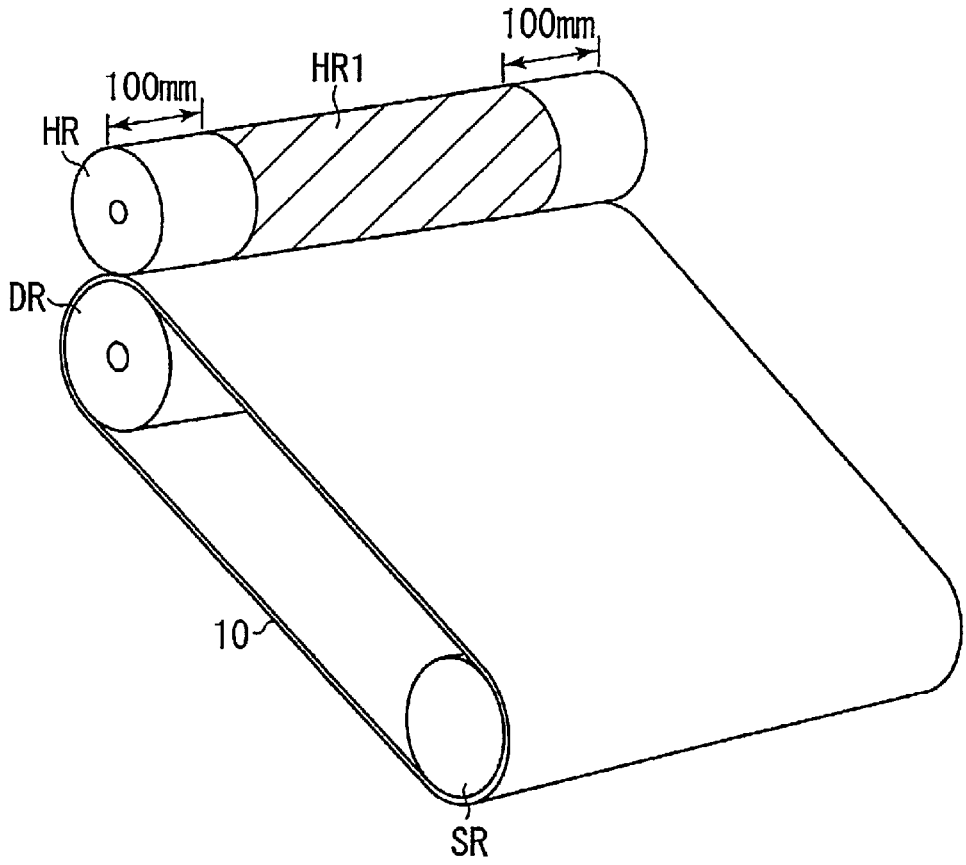
FIG. 6 is a perspective view of a tensile test apparatus to test durability of a calendering belt in accordance with the invention.

The tensile testing apparatus shown in FIG. 6 was used to test the durability of each calendering belt made according to the above-described examples, and endurance testing was conducted. The tensile test apparatus consisted of a feeding roller DR, a heating roller HR, and a support roller SR. The endless calendering belt 10 was installed on the feeding roller DR support roller SR and the heating roller HR was arranged above the feeding roller DR, to provide a compressing part.

In this tensile testing apparatus, a tensile force was applied to the calendering belt 10 by the feeding roller DR and the support roller SR, and the belt was compressed by the heating roller HR and the feeding roller DR. The width of each roller DR, HR, and SR was 500 mm.

A heat insulator HR1 covered the central portion of the heating roller HR, the distances from the ends of the insulator HR1 to the ends of the heating roller HR being 100 mm. The heat insulator HR1 performed a heat intercepting function equivalent to that of the paper web W in an actual calendering apparatus.

Two endurance tests (I and II) were performed. In endurance test I, the state of the belt was examined after a run for 100 hours under a tensile force of 1000 kgf/500 mm, a pressure 1 kgf/cm$^2$, and at heating roller temperatures of 150° C. and 300° C.

In endurance test II, the testing apparatus was run until cracks were generated in the calendering belt or separation occurred. Endurance test II was carried out at a tensile force 1000 kgf/500 mm and a heating roller temperature of 200° C., at three different pressures: 10 kgf/cm$^2$ 50 kgf/cm$^2$, and 100 kgf/cm$^2$.

From the test results shown in FIG. 7, it may be seen that the calendering belt 10 of the invention exhibited overall excellent durability compared with the conventional calendering belt. The test results show that a crack is not likely to be caused at the boundaries where the right and left potions 20 meet the main portion 30, and durability is improved, provided that the right and left portions 20 are 80 cm or more in width.

As will be apparent from the foregoing description, the calendering belt in accordance with the invention has the advantages of excellent durability and heat resistance property at a relatively low cost.

Furthermore, by providing reinforced edge portions at the outer edges of the right and left portions of the belt, it is possible to prevent damage to, or deterioration of, those portions, even if the edges of the belt knock against machine parts when the belt is installed in a calendering apparatus.

What is claimed is:

1. In combination with a calendering apparatus for paper manufacture in which a pressurizing part is composed of a pressing means and a heated calender roller, an endless calendering belt arranged to pass through said pressurizing part, said endless calendering belt being composed of a base portion and resin, the resin having a main central portion, and right and left portions located along right and left sides of the main central portion, said central portion and said right and left portions all being composed of high molecular weight elastic materials, said right and left portions being composed of a high molecular weight elastic material more resistant than the elastic material of the main central portion to the formation of cracks and wear as a result of exposure to heat, and said main central portion being composed of a high molecular weight elastic material more resistant than the material of said right and left portions to wear resulting from repeated compression in the pressing part of a calendering apparatus.

2. A combination of a calendering apparatus with an endless calendering belt according to claim 1, said belt having reinforced edge portions located along the outer edges of the right and left portions, the reinforced edge portions comprising high molecular weight elastic material more resistant than the material of said right and left portions to wear resulting from repeated compression in the pressing part of a calendering apparatus.

3. A combination of a calendering apparatus with an endless calendering belt according to claim 1, in which said right and left portions are composed of high molecular weight elastic material from the group consisting of polytetrafluoroethylene, a copolymer of tetrafluoroethylene and hexafluoroethylene, a copolymer of ethylene and tetrafluoroethylene, acrylic rubber, ethylene acrylic rubber, ethylene propylenediene rubber, fluoro rubber, silicone rubber, chlorinated polyethylene rubber, chlorosulfonated polyethylene rubber, and isobutylene-isoprene rubber.

4. A combination of a calendering apparatus with an endless calendering belt according to claim 3, in which said main central portion is composed of a rubber or other elastomer.

5. A combination of a calendering apparatus with an endless calendering belt according to claim 3, in which said main central portion is composed of polyurethane.

6. A combination of a calendering apparatus with an endless calendering belt according to claim 3, in which said main central portion is composed of polyurethane having a hardness from 80 to 95°.

7. An endless calendering belt for use in a calendering apparatus for paper manufacture in which a pressurizing part is composed of a pressing means and a heated calender roller, the belt being composed of a base portion and resin, the resin having a main central portion, and right and left portions located along right and left sides of the main central portion, said central portion and said right and left portions all being composed of high molecular weight elastic material, said right and left portions being composed of high molecular weight elastic material from the group consisting of polytetrafluoroethylene, a copolymer of tetrafluoroethylene and hexafluoroethylene, a copolymer of ethylene and tetrafluoroethylene, acrylic rubber, ethylene acrylic rubber, ethylene propylenediene rubber, fluoro rubber, silicone rubber, chlorinated polyethylene rubber, chlorosulfonated polyethylene rubber, and isobutylene-isoprene rubber, said material of the right and left portions being more resistant than the main central portion to the formation of cracks and wear as a result of exposure to heat, and said main central portion being composed of high molecular weight elastic material more resistant than the material of said right and left portions to wear resulting from repeated compression in the pressing part of a calendering apparatus.

8. An endless calendering belt according to claim 7, in which said main central portion is composed of a rubber or other elastomer.

9. An endless calendering belt according to claim 7, in which said main central portion is composed of polyurethane.

10. An endless calendering belt according to claim 7, in which said main central portion is composed of polyurethane having a hardness from 80 to 95°.

11. An endless calendering belt according to claim 7, having reinforced edge portions located along the outer edges of the right and left portions, the reinforced edge portions comprising high molecular weight elastic material more resistant than the material of said right and left portions to wear resulting from repeated compression in the pressing part of a calendering apparatus.

* * * * *